US009805851B2

(12) United States Patent
Watanabe et al.

(10) Patent No.: US 9,805,851 B2
(45) **Date of Patent: *Oct. 31, 2017**

(54) GRAIN-ORIENTED ELECTRICAL STEEL SHEET AND METHOD OF PRODUCING THE SAME

(71) Applicant: JFE STEEL CORPORATION, Chiyoda-ku, Tokyo (JP)

(72) Inventors: Makoto Watanabe, Tokyo (JP); Yukihiro Shingaki, Tokyo (JP); Toshito Takamiya, Tokyo (JP); Tomoyuki Okubo, Tokyo (JP)

(73) Assignee: JFE Steel Corporation, Tokyo (JP)

( * ) Notice: Subject to any disclaimer, the term of this patent is extended or adjusted under 35 U.S.C. 154(b) by 764 days.

This patent is subject to a terminal disclaimer.

(21) Appl. No.: 14/352,904

(22) PCT Filed: Oct. 16, 2012

(86) PCT No.: PCT/JP2012/076702

§ 371 (c)(1),
(2) Date: Apr. 18, 2014

(87) PCT Pub. No.: WO2013/058239

PCT Pub. Date: Apr. 25, 2013

(65) Prior Publication Data

US 2014/0251514 A1 Sep. 11, 2014

(30) Foreign Application Priority Data

Oct. 20, 2011 (JP) ..... 2011-230320
Jul. 20, 2012 (JP) ..... 2012-161140

(51) Int. Cl.
*H01F 1/147* (2006.01)
*C22C 38/02* (2006.01)
(Continued)

(52) U.S. Cl.
CPC ..... *H01F 1/14775* (2013.01); *C21D 8/0263* (2013.01); *C21D 8/1272* (2013.01);
(Continued)

(58) Field of Classification Search
CPC .. C21D 8/0263; C21D 8/1222; C21D 8/1233; C21D 8/1272; C21D 9/46; C22C 38/001;
(Continued)

(56) References Cited

U.S. PATENT DOCUMENTS 4,127,429 A * 11/1978 Ichida ..... C21D 8/1272 148/113
4,249,966 A * 2/1981 Ichida ..... C21D 9/46 148/113
(Continued)

FOREIGN PATENT DOCUMENTS

CN 101180411 5/2008
CN 101528950 9/2009
(Continued)

OTHER PUBLICATIONS

English translation of JP 2004/353054, Dec. 2004; 20 pages.*
(Continued)

*Primary Examiner* — Helene Klemanski
(74) *Attorney, Agent, or Firm* — RatnerPrestia

(57) ABSTRACT

In a method of producing a grain-oriented electrical steel sheet by hot rolling a steel slab comprising C: 0.001~0.10 mass %, Si: 1.0~5.0 mass %, Mn: 0.01~1.0 mass %, one or two of S and Se: 0.01~0.05 mass % in total, sol. Al: 0.003~0.050 mass % and N: 0.001~0.020 mass %, cold rolling, subjecting to primary recrystallization annealing, applying an annealing separator and finally subjecting to final annealing, the primary recrystallization annealing is conducted so as to control a heating rate S1 between 500 and 600° C. to not less than 100° C./s and a heating rate S2
(Continued)

(a) Twin generating ratio : 9%

Average grain size of underlying film: 0.76 μm (b) Twin generating ratio : 1.5%

Average grain size of underlying film: 0.56 μm

2 μm indicates a zone subjected to image analysis between 600 and 700° C. to not less than 30° C./s but not more than 0.6×S1, and as a main ingredient of the annealing separator is used MgO having an expected value μ(A) of citric acid activity distribution of 3.5~3.8, a cumulative frequency F of 25~45% when an activity A is not less than 4.0.

11 Claims, 2 Drawing Sheets

(51) Int. Cl.

| | |
|---|---|
| ***C22C 38/04*** | (2006.01) |
| ***C22C 38/06*** | (2006.01) |
| ***C22C 38/12*** | (2006.01) |
| ***C22C 38/16*** | (2006.01) |
| ***C22C 38/34*** | (2006.01) |
| ***C22C 38/60*** | (2006.01) |
| ***C21D 8/02*** | (2006.01) |
| ***C21D 8/12*** | (2006.01) |
| ***C21D 9/46*** | (2006.01) |
| ***H01F 1/16*** | (2006.01) |
| ***C22C 38/00*** | (2006.01) |
| ***C22C 38/08*** | (2006.01) |
| ***C23C 22/33*** | (2006.01) |
| ***C23C 22/74*** | (2006.01) |

(52) U.S. Cl.
CPC ..... *C21D 9/46* (2013.01); *C22C 38/001* (2013.01); *C22C 38/008* (2013.01); *C22C 38/02* (2013.01); *C22C 38/04* (2013.01); *C22C 38/06* (2013.01); *C22C 38/08* (2013.01); *C22C 38/12* (2013.01); *C22C 38/16* (2013.01); *C22C 38/34* (2013.01); *C22C 38/60* (2013.01); *C23C 22/33* (2013.01); *C23C 22/74* (2013.01); *H01F 1/16* (2013.01); *C21D 8/1222* (2013.01); *C21D 8/1233* (2013.01)

(58) Field of Classification Search
CPC ..... C22C 38/008; C22C 38/02; C22C 38/04; C22C 38/06; C22C 38/08; C22C 38/12; C22C 38/16; C22C 38/34; C22C 38/60; H01F 1/14775; H01F 1/16
USPC ..... 148/307, 645
See application file for complete search history.

(56) References Cited

U.S. PATENT DOCUMENTS

| | | | | |
|---|---|---|---|---|
| 4,504,957 | A | 3/1985 | McClelland | |
| 4,898,626 | A | 2/1990 | Shoen | |
| 5,833,768 | A * | 11/1998 | Kosuge | C21D 8/1272 148/111 |
| 5,858,126 | A * | 1/1999 | Takashima | H01F 1/14775 148/308 |
| 6,287,392 | B1 | 9/2001 | Toda | |
| 6,613,160 | B2 | 9/2003 | Ushigami | |
| 6,811,619 | B2 | 11/2004 | Hayakawa | |
| 7,291,230 | B2 | 11/2007 | Homma | |
| 7,727,644 | B2 * | 6/2010 | Watanabe | C21D 8/1272 148/111 |
| 7,857,915 | B2 | 12/2010 | Kumano | |
| 7,887,646 | B2 | 2/2011 | Nanba | |
| 7,942,982 | B2 | 5/2011 | Kubo | |
| 9,290,824 | B2 * | 3/2016 | Watanabe | C21D 8/1272 |
| 2002/0000265 | A1 | 1/2002 | Toda | |
| 2010/0055481 | A1 | 3/2010 | Kubo | |
| 2011/0067786 | A1 | 3/2011 | Takashima | |
| 2011/0155285 | A1 | 6/2011 | Kumano | |
| 2013/0074996 | A1 | 3/2013 | Omura | |
| 2013/0189490 | A1 * | 7/2013 | Watanabe | C22C 38/34 428/164 |
| 2014/0202599 | A1 * | 7/2014 | Watanabe | C21D 8/1272 148/579 |
| 2014/0251514 | A1 | 9/2014 | Watanabe | |
| 2014/0338794 | A1 | 11/2014 | Shingaki | |
| 2015/0007908 | A1 * | 1/2015 | Watanabe | C21D 8/1272 148/111 |
| 2015/0243419 | A1 * | 8/2015 | Senda | C21D 8/1222 148/111 |

FOREIGN PATENT DOCUMENTS

| | | | |
|---|---|---|---|
| EP | 0716151 | | 6/1996 |
| EP | 1057898 | | 12/2000 |
| EP | 2746410 | | 6/2014 |
| EP | 2757165 | | 7/2014 |
| EP | 2770075 | | 8/2014 |
| JP | 53-5800 | A | 1/1978 |
| JP | 0578743 | | 3/1993 |
| JP | 6-100996 | A | 4/1994 |
| JP | 06-179977 | A | 6/1994 |
| JP | 7-62436 | A | 3/1995 |
| JP | 10298653 | | 11/1998 |
| JP | 2000063950 | | 2/2000 |
| JP | 2000144249 | | 5/2000 |
| JP | 2000204450 | | 7/2000 |
| JP | 2000-256810 | A | 9/2000 |
| JP | 2000355717 | | 12/2000 |
| JP | 2003027194 | | 1/2003 |
| JP | 2003213339 | | 7/2003 |
| JP | 2003253341 | | 9/2003 |
| JP | 3537339 | | 3/2004 |
| JP | 2004115858 | | 4/2004 |
| JP | 2004-353054 | A | 12/2004 |
| JP | 2008-1977 | A | 1/2008 |
| JP | 2010236013 | | 10/2010 |
| JP | 20116738 | | 1/2011 |
| JP | 2011174138 | | 9/2011 |
| JP | 2012-207278 | A | 10/2012 |
| KR | 20120074030 | | 7/2012 |
| WO | WO 2008/047999 | A1 * | 4/2008 |
| WO | 2009091127 | | 7/2009 |
| WO | 2011105054 | | 9/2011 |

OTHER PUBLICATIONS

International Search Report dated Jan. 22, 2013 in International Application No. PCT/JP2012/076702.
Chinese Office Action dated May 6, 2015 for Chinese Application No. 201280051569.X, including English translation.
Chinese Office Action dated Jan. 14, 2016 for Chinese Application No. 201280051569.X, including partial English translation.
Chinese Office Action dated Aug. 4, 2014, application No. 201280035465.X, with English translation.
Entire patent prosecution history of U.S. Appl. No. 14/235,935, filed Jan. 29, 2014, entitled, "Method for Producing Oriented Electromagnetic Steel Sheet."
Entire patent prosecution history of U.S. Appl. No. 14/344,805, filed Mar. 13, 2014, entitled, "Method of Producing Grain-Oriented Electrical Steel Sheet Having Excellent Iron Loss Properties."
Entire patent prosecution history of U.S. Appl. No. 14/431,577, filed Mar. 26, 2015, entitled, "Method for Producing Grain-Oriented Electrical Steel Sheet."
European Search Report dated Jun. 1, 2015 in European Application No. 12832398.7.
International Preliminary Report on Patentability and Written Opinion dated Feb. 18, 2014, application No. PCT/JP2012/070758.
International Preliminary Report on Patentability and Written Opinion dated Mar. 18, 2014, application No. PCT/JP2012/073608.
International Preliminary Report on Patentability and Written Opinion dated Mar. 31, 2015 for International Application No. PCT/JP2012/074858.
International Search Report dated Dec. 11, 2012 in International Application No. PCT/JP2012/073608.

(56) References Cited

OTHER PUBLICATIONS

International Search Report dated Oct. 30, 2012 for International Application No. PCT/JP2012/070758.
Jan. 8, 2013 International Search Report issued in International Patent Application No. PCT/JP2012/074858.
Nov. 11, 2014 Office Action issued in Japanese Patent Application No. 2014-537945.
Second Chinese Office Action dated Apr. 22, 2015 for Chinese Application No. 201280035465.X, with English translation.
Sep. 1, 2015 extended European Search Report issued in European Patent Application No. 12885788.5.
European Search Report dated Sep. 15, 2015 in European Application No. 12841595.7.
Final Office Action dated Oct. 23, 2015 for U.S. Appl. No. 14/235,652.
Non-Final Office Action dated May 8, 2015 for U.S. Appl. No. 14/235,652.
Notice of Allowance dated Nov. 12, 2015 in U.S. Appl. No. 14/235,935.
Final Office Action dated Nov. 20, 2015 for U.S. Appl. No. 14/431,577.
Non Final Office Action for U.S. Appl. No. 14/235,652, dated Jul. 21, 2016, 19 pages.
Final Office Action dated Apr. 15, 2016 for U.S. Appl. No. 14/344,805.
Final Office Action dated Sep. 8, 2016 for U.S. Appl. No. 14/431,577, 10 pages.
Notice of Allowance for U.S. Appl. No. 14/235,652, dated Jan. 30, 2017, 19 pages.
Non-Final Office Action dated Dec. 15, 2016 for U.S. Appl. No. 14/344,805, 18 pages.

* cited by examiner

[Fig.1]
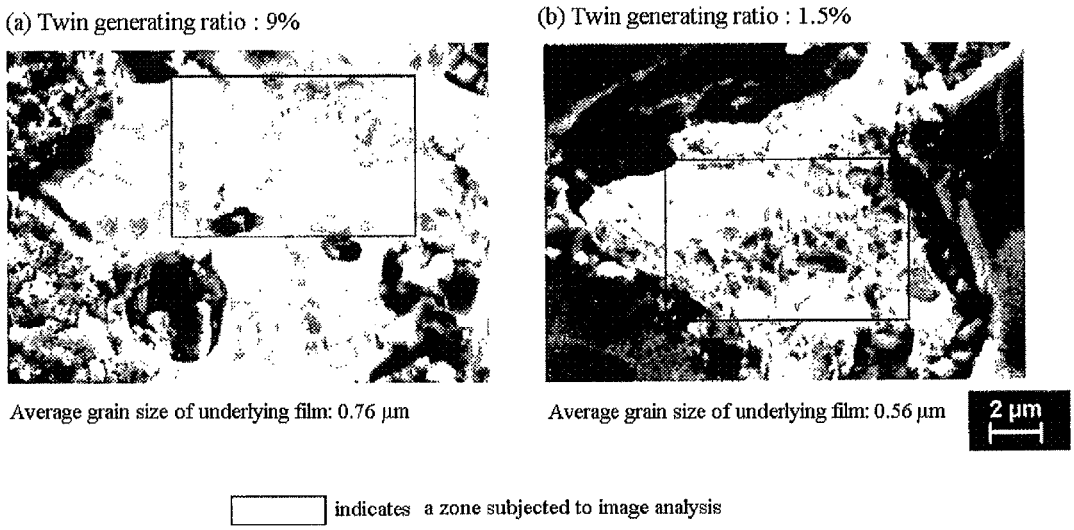
[Fig.2]
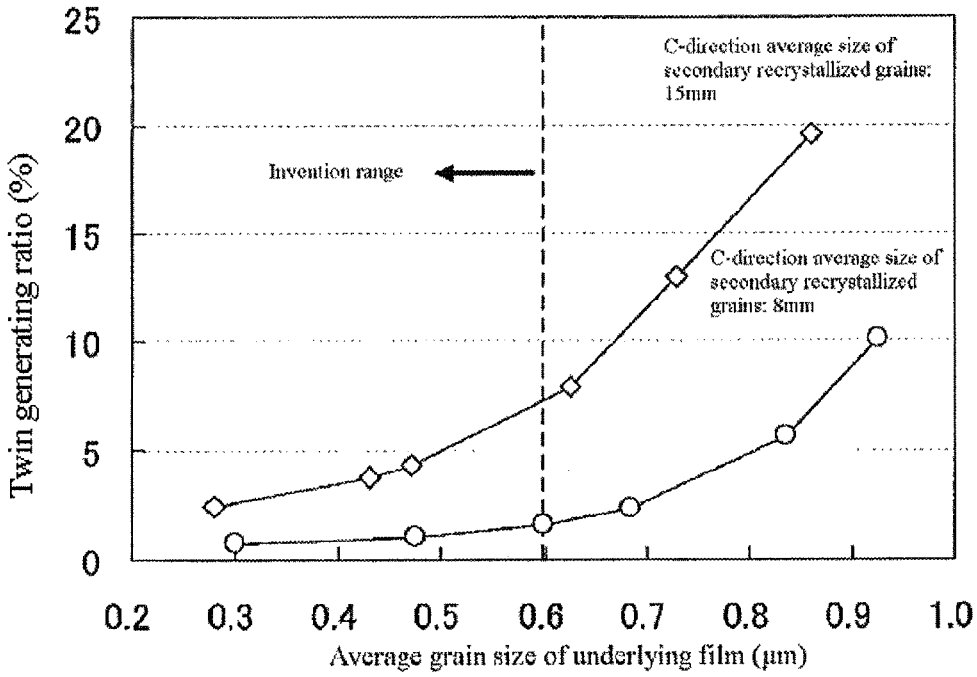

[Fig.3]
(a) Twin generating ratio : 9%
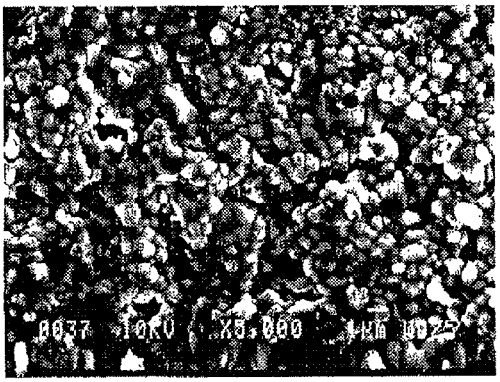
(b) Twin generating ratio : 1.5%
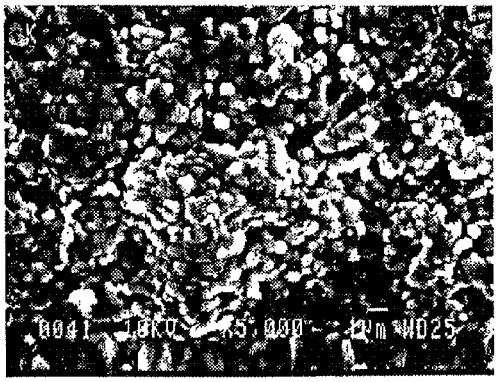
1 μm
[Fig.4]
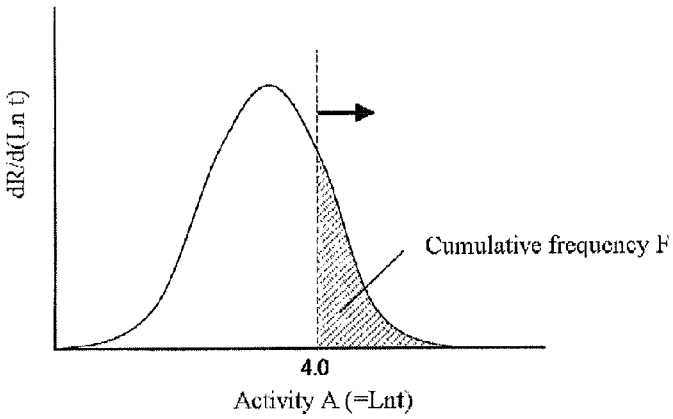

GRAIN-ORIENTED ELECTRICAL STEEL SHEET AND METHOD OF PRODUCING THE SAME

CROSS REFERENCE TO RELATED APPLICATIONS

This is the U.S. National Phase application of PCT International Application No. PCT/JP2012/076702, filed Oct. 16, 2012, and claims priority to Japanese Patent Application No. 2011-230320, filed Oct. 20, 2011, and Japanese Patent Application No. 2012-161140, filed Jul. 20, 2012, the disclosures of each of these applications being incorporated herein by reference in their entireties for all purposes.

FIELD OF THE INVENTION

This invention relates to a grain-oriented electrical steel sheet mainly used in a core of a transformer, an electric machinery, a power generator or the like, and more particularly to a grain-oriented electrical steel sheet hardly causing a twin even if being subjected to a relatively strong bending, shearing or the like as in a core of a small-sized power generator or a small-sized electric machinery, a wound core or an EI core, and a method of producing the same.

BACKGROUND OF THE INVENTION

A grain-oriented electrical steel sheets and a non-oriented electrical steel sheet are widely used as core materials for various transformers, electric machineries, power generators and the like. Among them, the grain-oriented electrical steel sheet is featured to have good iron loss properties directly leading to reduction of energy loss in the transformer, power generator or the like that the magnetic flux density is high and the iron loss is low because crystal orientation is highly accumulated in {110}<001> orientation called Goss orientation.

When the core of the small-sized power generator or the small-sized electric machinery, the EI core or the like is manufactured by using such a grain-oriented electrical steel sheet, punching or shearing is frequently conducted after the leveling for correcting a coil form. In the leveling, punching or shearing, however, twining deformation is caused in the steel sheet to generate cracking, chipping or warping, whereby production troubles may be caused. Even in the production of the wound core, twin is generated when the steel sheet is wound in the form of a coil, whereby magnetic properties may be deteriorated.

To this end, there are proposed various techniques for improving workability. For example, Patent Document 1 proposes a technique of suppressing the generation of twin by reducing S and N among ingredients of a raw material and adding $SO_3$ compound to an annealing separator in an amount of 0.5~5.0 mass % as $SO_3$ weight. Also, Patent Document 2 proposes a technique of preventing the cracking in the shearing or bending by restricting Ti concentration in the steel sheet inclusive of forsterite film to a range of 1.0~2.0 times of N concentration to reduce N in steel.

PATENT DOCUMENTS

Patent Document 1: JP-A-2000-256810
Patent Document 2: JP-A-H06-179977

SUMMARY OF THE INVENTION

Although the workability of the grain-oriented electrical steel sheet can be improved by applying the technique of Patent Document 1 or 2 without deteriorating the magnetic properties, it is a situation that the improvement is still imperfect. For example, when Patent Document 1 is applied, the twin generating ratio is largely decreased, but a high value of about 10% may be taken within a range of variance. While, when Patent Document 2 is applied, the bending workability is improved by adjusting Ti/N concentration ratio, but the twin generating ratio can be decreased only to a limited level.

The invention is made in view of the above problems inherent to the conventional techniques and is to provide a grain-oriented electrical steel sheet wherein the cracking, chipping or the like due to the twining deformation is not generated and the magnetic properties are not deteriorated even in the applications subjected to strong working as in the core of the small-sized power generator, the wound core or the like by developing a production technique of the grain-oriented electrical steel sheet capable of reducing the twin generating ratio as compared with the conventional technique and to propose a method of producing the same.

The inventors have made a large number of experiments for solving the problems and examined a way of reducing the twin generating ratio as compared with the conventional technique. As a result, it has been found that it is effective to reduce the twin generating ratio when grain size of forsterite constituting an underlying film (forsterite film), particularly an average grain size of traces of the underlying film constituting grains transferred on an exfoliated face at a matrix side (steel sheet side) after the film exfoliating test, and C-direction average size of secondary recrystallized grains of the matrix are made small. That is, the twin generating ratio can be considerably reduced by making the C-direction grain size of the secondary recrystallized grains of the steel sheet small in addition to the adjustment of interface conditions between the forsterite film and the matrix. To this end, it has been found that it is important to control a heating rate in the course of heating for primary recrystallization annealing at a low temperature region and a high temperature region and also to control an activity distribution of MgO as a main ingredient of an annealing separator to an adequate range, and as a result the invention has been accomplished.

That is, the invention includes a grain-oriented electrical steel sheet having a chemical composition comprising Si: 1.0~5.0 mass %, Mn: 0.01~1.0 mass % and the remainder being Fe and inevitable impurities and including an underlying film composed mainly of forsterite and an overcoat film, characterized in that an average grain size of traces of the underlying film constituting grains observed on an exfoliated portion on a steel sheet side after the film exfoliating test is not more than 0.6 μm and a C-direction average size of secondary recrystallized grains is not more than 8 mm, and a twin generating ratio after the twining test is not more than 2%.

In addition to the above chemical composition, the grain-oriented electrical steel sheet of an embodiment of the invention is characterized by containing one or more selected from Cu: 0.01~0.2 mass %, Ni: 0.01~1.0 mass %, Cr: 0.01~0.5 mass %, Sb: 0.01~0.1 mass %, Sn: 0.01~0.5 mass %, Mo: 0.01~0.5 mass % and Bi: 0.001~0.1 mass %.

In addition to the above chemical composition, the grain-oriented electrical steel sheet of an embodiment of the invention is further characterized by containing one or more selected from B: 0.001~0.01 mass %, Ge: 0.001~0.1 mass %, As: 0.005~0.1 mass %, P: 0.005~0.1 mass %, Te: 0.005~0.1 mass %, Nb: 0.005~0.1 mass %, Ti: 0.005~0.1 mass % and V: 0.005~0.1 mass %.

Further, the invention proposes a method of producing a grain-oriented electrical steel sheet by hot rolling a steel slab having a chemical composition comprising C, 0.001~0.10 mass %, Si: 1.0~5.0 mass %, Mn: 0.01~1.0 mass %, one or two of S and Se: 0.01~0.05 mass % in total, sol. Al: 0.003~0.050 mass %, N: 0.001~0.020 mass % and the remainder being Fe and inevitable impurities, subjecting to a hot band annealing if necessary, subjecting to a single cold rolling or two or more cold rollings with an intermediate annealing therebetween to a final thickness, subjecting to primary recrystallization annealing, applying an annealing separator and finally subjecting to final annealing, characterized in that the primary recrystallization annealing is conducted so as to control a heating rate S1 between 500° C. and 600° C. to not less than 100° C./s and a heating rate S2 between 600° C. and 700° C. to not less than 30° C./s but not more than 0.6×S1, and as a main ingredient of the annealing separator is used MgO having an expected value μ(A) of citric acid activity distribution of 3.5~3.8, an activity A of not less than 4.0 and a cumulative frequency F of 25~45%.

The production method of the grain-oriented electrical steel sheet according to an embodiment of the invention is characterized in that decarburization annealing is conducted after the primary recrystallization annealing by heating at the above heating rate.

In the production method of the grain-oriented electrical steel sheet according to an embodiment of the invention, the steel slab is characterized by containing one or more selected from Cu: 0.01~0.2 mass %, Ni: 0.01~1.0 mass %, Cr: 0.01~0.5 mass %, Sb: 0.01~0.1 mass %, Sn: 0.01~0.5 mass %, Mo: 0.01~0.5 mass % and Bi: 0.001~0.1 mass % in addition to the above chemical composition.

In the production method of the grain-oriented electrical steel sheet according to an embodiment of the invention, the steel slab is characterized by containing one or more selected from B: 0.001~0.01 mass %, Ge: 0.001~0.1 mass %, As: 0.005~0.1 mass %, P: 0.005~0.1 mass %, Te: 0.005~0.1 mass %, Nb: 0.005~0.1 mass %, Ti: 0.005~0.1 mass % and V: 0.005~0.1 mass % in addition to the above chemical composition.

According to the invention, there can be provided grain-oriented electrical steel sheets hardly causing the twining deformation even in applications subjected to strong working and being less in the deterioration of magnetic properties, so that it is possible to manufacture power generators, transformers and so on capable of decreasing troubles such as cracking, chipping and the like during the working to a core of a small-sized power generator, a wound core or the like and being less in the energy loss.

BRIEF DESCRIPTION OF THE DRAWINGS

FIG. 1 shows photographs of underlying film-exfoliated portions of a steel sheet having a low twin generating ratio and a steel sheet having a high twin generating ratio observed by SEM, respectively.

FIG. 2 is a graph showing a relation between average grain size of grains constituting an underlying film observed in an exfoliated portion at a matrix side and twin generating ratio after the film exfoliating test.

FIG. 3 shows photographs obtained by observing underlying films of the steel sheet having a low twin generating ratio and the steel sheet having a high twin generating ratio shown in FIG. 1 with SEM from their surfaces, respectively.

FIG. 4 is a view illustrating the cumulative frequency F in an embodiment of the invention.

DETAILED DESCRIPTION OF EMBODIMENTS OF THE INVENTION

At first, a grain-oriented electrical steel sheet aiming at the invention will be described.

The grain-oriented electrical steel sheet aiming at the invention is usually a well-known one having an underlying film composed mainly of forsterite ($Mg_2SiO_4$) (so-called forsterite film) and an overcoat film coated thereon (insulating film).

In the grain-oriented electrical steel sheet of an embodiment of the invention, however, it is preferable that an average size of secondary recrystallized grains in C-direction (direction perpendicular to rolling direction) is not more than 8 mm. The reason why the C-direction average size is preferably limited to the above range is due to the fact that since twin usually takes a form extended in the C-direction, when the C-direction size of the secondary recrystallized grains is made small, local concentration of strain given during the working can be obstructed to prevent twining deformation. Therefore, the invention cannot be easily applied to a technique wherein the coil is annealed under a temperature gradient to extend crystal grains in the C-direction. In contrast, the extension of the grains in a L-direction (rolling direction) is permissible, only if the C-direction average is small.

The preferable C-direction average size of the secondary recrystallized grains is not more than 6 mm.

Further, the grain-oriented electrical steel sheet of an embodiment of the invention is preferably produced such that an average grain size of traces of grains (forsterite grains) constituting the underlying film transferred and observed on an exfoliated face at the matrix side (steel sheet side) after the film exfoliating test is not more than 0.6 μm.

Here, the film exfoliating test is a test wherein the adhesion of the film is evaluated by determining minimum bending size (diameter) causing no exfoliating of the film when the steel sheet is wound on the cylindrical rod having different diameters.

In the invention, the average grain size of the grains constituting the underlying film is determined by exfoliating the film through bending test with a diameter smaller than the minimum bending diameter, cutting out a portion capable of observing the exposed face of the matrix, observing the underlying film-exfoliated portion at the matrix side (steel sheet side) by means of SEM, and conducting image analysis for grain size of traces of the transferred grains constituting the underlying film (forsterite grains). In this case, the remaining portion of the film and neck portion to anchor are eliminated from the image analysis area.

FIG. 1 shows SEM photographs of the underlying film exfoliated portions between the steel sheet having a low twin generating ratio and the steel sheet having a high twin generating ratio in comparison. As seen from this figure, the traces of forsterite grains constituting the underlying film are clearly left on the surface of the film-exfoliated portion at the matrix side (steel sheet side), and the grain size of the grains constituting the underlying film observed in the steel sheet having a low twin generating ratio is smaller than that in the steel sheet having a high twin generating ratio. Moreover, the twin generating ratio in this figure is a ratio (%) of the number of the samples generating twin to the total number of test samples obtained by the same method as in Patent Document 1, concretely by subjecting 60 or more JIS No. 5 test samples to a tensile test with a tensile rate of 10 m/min at room temperature, macro-etching with pickling, and visually observing twin line thereon.

FIG. 2 shows a relation between the grain size of the grains constituting the underlying film and the twin generating ratio by measuring the forsterite grain size transferred on the underlying film-exfoliated portion after the exfoliating test on steel sheets having C-direction average sizes of secondary recrystallized grains of 15 mm and 8 mm and different twin generating ratios through the aforementioned method. As seen from this figure, it is difficult to reduce the twin generating ratio in the steel sheet having C-direction size of secondary recrystallized grains of 15 mm, while the twin generating ratio in the steel sheet having C-direction size of secondary recrystallized grains of 8 mm can be reduced to a very low level of not more than 2% by making the grain size of the grains constituting the underlying film to not more than 0.6 μm.

Although the causes bringing about such results are not yet clear, the inventors think as follows:

In the grain-oriented electrical steel sheet, orientation of the secondary recrystallized grains is highly accumulated in {110}<001>. In the steel sheet having such a crystal orientation, when deformation is applied to the rolling direction, {112}<111> slip system is involved to cause twining deformation. However, the twining deformation occurs only when strain rate is fast or when deformation is caused at a lower temperature because the deformation energy is high.

A starting point of such twining deformation is considered to be an interface between matrix and film mostly storing strain when being subjected to the deformation. Therefore, it is considered that when the forsterite grain size in the interface is large, undulation of the steel sheet portion increases and also the tension effect by forsterite film becomes anisotropic, and hence local stress concentration is caused to easily form twin.

Moreover, the grain size of the grains constituting the underlying film is disclosed in many known articles, but is often a result obtained by observing the film surface with SEM or the like, which is not in accordance with the grain size at the interface between matrix and film. As reference, SEM photographs of forsterite films observed from surfaces of the steel sheets having different twin generating ratios in FIG. 1 are shown in FIG. 3. From this figure, it can be seen that since the forsterite grain size on the surface is substantially equal, the grain size of forsterite largely differs between the surface and matrix-film interface.

Therefore, the generation of twin cannot be suppressed only by making forsterite grain size observed from the surface of the underlying film small, while the twin can be suppressed only by making the grain size in the matrix-film interface small.

As seen from the above results, in order to suppress the generation of twin in the grain-oriented electrical steel sheet, it is important to make both of the C-direction size of the secondary recrystallized grains and the grain size of the underlying film constituting grains (forsterite grains) transferred on the matrix side finer. Moreover, the average grain size of the traces of grains constituting the underlying film is preferable to be not more than 0.5 μm.

Next, there will be described the chemical composition of the steel slab used in the production of the grain-oriented electrical steel sheet according to embodiments of the invention.

C: 0.001~0.10 Mass %

C is an ingredient required for generating crystal grains of Goss orientation and is required to be contained in not less than 0.001 mass % in order to develop such an action. While when the addition amount of C exceeds 0.10 mass %, it is difficult to conduct decarburization by subsequent decarburization annealing to such a level that magnetic aging is not caused. Therefore, C content is in a range of 0.001~0.10 mass %. Preferably, it is in a range of 0.015~0.08 mass %.

Si: 1.0~5.0 Mass %

Si is an ingredient required for enhancing electric resistance of steel to reduce iron loss and stabilizing BCC structure to permit high-temperature heat treatment and is necessary to be added in an amount of at least 1.0 mass %. However, when it exceeds 5.0 mass %, the workability is lowered and the production becomes difficult by cold rolling. Therefore, Si content is in a range of 1.0..5.0 mass %. Preferably, it is in a range of 2.0~4.0 mass %.

Mn: 0.01~1.0 Mass %

Mn is effective to improve hot embrittlement of steel and is an element functioning as a retarder (inhibitor) by forming precipitate of MnS, MnSe or the like if the steel contains S or Se. Such effects are obtained by adding in an amount of not less than 0.01 mass %. However, if it exceeds 1.0 mass %, the precipitates of MnS and the like are coarsened to lose the effect as the inhibitor. Therefore, Mn content is in a range of 0.01~1.0 mass %. Preferably, it is in a range of 0.03~0.50 mass %.

Sol. Al: 0.003~0.050 Mass %

Al forms MN in steel and is a useful ingredient acting as an inhibitor of a second dispersion phase. However, when the content as sol. Al is less than 0.003 mass %, sufficient amount of AlN cannot be ensured, while when it exceeds 0.050 mass %, AlN is coarsely precipitated to lose the action as an inhibitor. Therefore, Al content as sol. Al is in a range of 0.003~0.050 mass %. Preferably, it is in a range of 0.005~0.03 mass %.

N: 0.001~0.020 Mass %

N is an ingredient required for forming AlN with Al to act as an inhibitor. However, when the content is less than 0.001 mass %, precipitation of AlN is insufficient, while when it exceeds 0.020 mass %, blistering or the like is caused during the slab heating. Therefore, N content is in a range of 0.001~0.020 mass %. Preferably, it is in a range of 0.002~0.015 mass %.

One or Two of S and Se: 0.01~0.05 Mass % in Total

S and Se are useful elements wherein they are bonded with Mn or Cu to form MnSe, MnS, $Cu_{2-x}Se$, and $Cu_{2-x}S$ and precipitated into steel as a second dispersion phase to develop an action of an inhibitor. When the content in total of S and Se is less than 0.01 mass %, the above addition effect is not sufficient, while when it exceeds 0.05 mass %, solution treatment of S and Se is imperfect in the slab heating and also surface defects are caused in a product sheet. Therefore, the content of these elements is in a range of 0.01~0.05 mass % in case of single addition or composite addition. Preferably, it is in a range of 0.015~0.028 mass %.

Among the above ingredients, C is removed from steel by decarburization in the course of the production steps, and Al, N, S and Se are removed from steel by refining in the final annealing, so that all of these contents become levels of inevitable impurities.

In addition to the above chemical composition, the steel slab used in the production of the grain-oriented electrical steel sheet according to the invention may further contains one or more selected from Cu: 0.01~0.2 mass %, Ni: 0.01~1.0 mass %, Cr: 0.01~0.5 mass %, Sb: 0.01~0.1 mass %. Sn: 0.01~0.5 mass %, Mo: 0.01~0.5 mass % and Bi: 0.001~0.1 mass %.

These elements act as an auxiliary inhibitor by segregating into crystal grain boundaries or steel sheet surface and have an effect of improving the magnetic properties, so they may be added according to the need. However, when the content of each element is less than the above lower limit, the effect of suppressing coarsening of primary grains is insufficient at the high temperature zone in the course of secondary recrystallization. While, when it exceeds the above upper limit, poor appearance of forsterite film or defect of the secondary recrystallization is easily caused. Therefore, if they are added, the content is preferably within the above range.

Also, in addition to the above chemical composition, the steel slab used in the production of the grain-oriented electrical steel sheet according to the invention may further contain one or more selected from B: 0.001~0.01 mass %, Ge: 0.001~0.1 mass %, As: 0.005~0.1 mass %, P: 0.005~0.1 mass %, Te: 0.005~0.1 mass %, Nb: 0.005~0.1 mass %, Ti: 0.005~0.1 mass % and V: 0.005~0.1 mass %.

These elements have an effect of reinforcing inhibitor effect (suppressing force) to stably enhance magnetic flux density, and can be added, if necessary.

The production method of the grain-oriented electrical steel sheet according to embodiments of the invention will be described below.

The grain-oriented electrical steel sheet according to the invention can be produced by the production method comprising a series of steps by melting a steel having the abovementioned chemical composition by the conventionally known refining process, forming a steel material (steel slab) with a continuous casting method, an ingot making-blooming method or the like, hot rolling the steel slab to form a hot rolled sheet, subjecting to a hot band annealing, if necessary, and subsequently to a single cold rolling or two or more cold rollings with an intermediate annealing therebetween to obtain a cold rolled sheet having a final thickness, subjecting to a primary recrystallization annealing or primary recrystallization annealing combined with decarburization annealing, subjecting to nitriding if necessary, applying an annealing separator composed mainly of MgO to the surface of the steel sheet, drying, finally subjecting to final annealing and subsequently to a flattening annealing combining with application and baking of an insulating film. Among the above production steps, the conditions other than the primary recrystallization annealing and the annealing separator are not particularly limited, and the conventionally known conditions can be adopted.

Now, the primary recrystallization annealing conditions and the conditions of the annealing separator will be described below.

<Primary Recrystallization Annealing>

In the primary recrystallization annealing according to an embodiment of the invention, the heating rate S1 between 500~600° C. is preferred to be not less than 100° C./s. This is a treatment for making the C-direction grain size of the crystal grains small. When it is less than 100° C./s, the C-direction grain size becomes too large. When S1 is not less than 100° C./s, there is an effect that the temperature of recovering and recrystallizing the steel sheet is raised to decrease a sub-boundary density, which largely affects on a quantity of initial oxidation caused above 600° C. Preferably, S1 is not less than 120° C./s.

Also, the heating rate S2 between 600~700° C. in the primary recrystallization annealing of an embodiment of the invention is preferably not less than 30° C./s but not more than 0.6×S1. The reason why it is not more than 0.6×S1 is based on the point of ensuring the initial oxidation quantity. In the invention, since S1 is fast, the sub-boundary density is lowered. Since the initial oxidation is caused from the sub-boundary of recovered cell structure, the initial oxidation becomes insufficient if S2 exceeds 0.6×S1. On the other hand, the reason why S2 is not less than 30° C./s is due to the fact that the C-direction grain size of the crystal grains is made finer and the initial oxidation quantity is not made too high. If it is less than 30° C./s, the initial oxidation quantity becomes too high. Such an adjustment of S2 controls the initial oxidation quantity to a predetermined range, whereby the oxidation rate in the soaking can be made adequate to provide optimum sub-scale properties. Preferable S2 is not less than 40° C./s but not more than 0.5×S1.

When the initial oxidation quantity formed by the primary recrystallization annealing is small, dendrite-like sub-scale having a low atmosphere protection in the final annealing is formed, while when the initial oxidation quantity is large, subsequent oxidation is controlled to form sub-scale having a low oxygen basis weight, which deteriorates the atmosphere protection in the final annealing. If the atmosphere protection in the final annealing is deteriorated, enrichment of silica ($SiO_2$) to surface layer is delayed to a high temperature zone to cause film formation in an interface between film and matrix at the high temperature zone, so that the forsterite grain size is coarsened at the interface. Therefore, only by controlling S2 so as to set to the aforementioned proper range can be made fine the grain size of the grains constituting the underlying film at the interface between film and matrix to suppress the occurrence of twin.

In general, the primary recrystallization annealing after the final cold rolling is frequently carried out in combination with decarburization annealing. Even in the invention, the primary recrystallization annealing may be conducted in combination with decarburization annealing. Alternatively, after the primary recrystallization annealing is conducted by heating under the above temperature rising conditions and dropping the temperature once, decarburization annealing may be conducted again.

Also, other conditions in the primary recrystallization annealing of the invention such as soaking temperature, soaking time, atmosphere in soaking, cooling rate and the like are not particularly limited as long as it may be conducted according to usual manner.

Further, the inhibitor may be reinforced by subjecting to nitriding before or after the primary recrystallization annealing or during the primary recrystallization annealing. Thus, the nitriding may be applied even in the invention.

<Annealing Separator>

After the primary recrystallization annealing or the primary recrystallization annealing combined with decarburization annealing by heating at the above heating rates, the steel sheet is coated on its surface with the annealing separator, dried and subjected to final annealing.

In the invention, it is advantageous to use MgO having an activity distribution controlled to a proper range as a main ingredient of the annealing separator, concretely to use MgO having an expected value $\mu(A)$ of citric acid activity distribution of 3.5~3.8, and a cumulative frequency F of 25~45% when an activity A is not less than 4.0.

In this case, the "activity distribution" of MgO is represented by a distribution of differential curve obtained by reacting MgO with citric acid and determining a change in a reactivity R (%) during the reaction with lapse of time through an optical means according to the method described in JP-A-2004-353054. Thus, it is possible to anticipate reaction rate at each stage from start to finish of the reaction, whereby the activity in the production of MgO can be controlled and the judgment on suitability for using as a material involving any reaction can be easily conducted.

The expected value μ(A) is determined as follows.

When the reaction time between MgO and citric acid is t (sec), the activity A is A=Lnt (wherein Lnt is a natural logarithm of the reaction time t (sec)). Assuming that P(A)=dR/d(Lnt)=dR/dA, then, μ(A) can be calculated as $$\mu(A)=\int A\cdot P(A)dA.$$

Also, the "cumulative frequency F when the activity A is not less than 4.0" is determined by integrating P(A) in a range of the activity A of not less than 4.0 when an abscissa is represented by the activity A (natural logarithm of reaction time Lnt) and an ordinate is represented by derivative of the reaction ratio R at the activity A (dR/dA=P(A)).

The reason why the invention uses MgO having the activity distribution controlled to the above range is due to the fact that the expected value (average value) of the activity distribution of MgO is shifted toward a slightly low activity side as mentioned above to suppress forsterite forming reaction at a low temperature zone of the final annealing and the reaction at a high temperature zone is enhanced to increase the number of producing forsterite nuclei and make the forsterite grain size fine and reduce twin generating ratio in the working of the steel sheet.

When the expected value μ(A) of the activity distribution of MgO is less than 3.5, or when cumulative frequency F is less than 25%, the forsterite forming reaction at the low temperature zone is promoted to make the grain growth of forsterite excessive, while when it exceeds 3.8 or when the cumulative frequency F exceeds 45%, the forsterite forming reaction at the high temperature zone does not proceed sufficiently and the forsterite film is deteriorated. Preferably, the expected value μ(A) of the activity distribution of MgO is in a range of 3.6~3.7 and the cumulative frequency F when the activity A is not less than 4.0 is in a range of 30~40%.

In addition to MgO as a main ingredient, the annealing separator used in the invention may be added with the conventionally known titanium oxide, borates, sulfates, carbonates, hydroxides, chlorides and the like of Mg, Ca, Sr, Na, Li, Sn, Sb, Cr, Fe, Ni and so on alone or compositely.

Also, it is preferable that the amount of the annealing separator applied to the surface of the steel sheet is 8~16 g/m$^2$ on both sides and the hydration amount is in a range of 0.5~3.7 mass %.

Moreover, in order to reduce iron loss in the production method of the grain-oriented electrical steel sheet according to the invention, linear grooves are formed on the surface of the steel sheet after the cold rolling to final thickness, or the steel sheet after the final annealing or after the formation of the insulating film (top film) may be subjected to a treatment of refining magnetic domains by irradiating laser, plasma, electron beam or the like.

Example 1

A steel slab comprising C, 0.07 mass %, Si: 3.3 mass %, Mn: 0.08 mass %, Se: 0.02 mass %, sol. Al: 0.03 mass %, N: 0.007 mass %, Cu: 0.2 mass %, Sb: 0.03 mass %, and the remainder being Fe and inevitable impurities is heated to 1430° C. and soaked for 30 minutes, hot rolled to form a hot rolled sheet having a thickness of 2.2 mm, which is subjected to a hot band annealing of 1000° C.×1 minute and cold rolled to obtain a cold rolled sheet having a final thickness of 0.23 mm. Thereafter, the cold rolled sheet is subjected to primary recrystallization annealing combined with decarburization annealing by heating while variously changing heating rate S1 between 500~600° C. and heating rate S2 between 600~700° C. as shown in Table 1 and soaking at 840° C. for 2 minutes, coated on both surfaces with a slurry-state annealing separator obtained by variously changing an expected value μ(A) of activity distribution and a cumulative frequency F of MgO as a main ingredient and adding 10 mass % of $TiO_2$ in an amount of 15 g/m$^2$ so as to provide hydration amount of 3.0 mass %, dried, wound in form of a coil, and subjected to final annealing. Then, the steel sheet is coated on its surface with a coating liquid of magnesium phosphate-colloidal silica-chromic anhydride-silica powder and subjected to flattening annealing for the purpose of baking and shape correction to obtain a product coil.

TABLE 1

| | Primary recrystallization heating rate (° C./s) | | | Activity of annealing separator | | C-direction | | | |
|---|---|---|---|---|---|---|---|---|---|
| No. | S1 | S2 | S2/S1 | Expected value μ(A) | A ≥ 4 Cumulative frequency F (%) | average size of secondary recrystallized grains (mm) | Grain size of underlying film (μm) | Twin generating ratio (%) | Remarks |
| 1 | 20 | 5 | 0.25 | 3.6 | 32 | 35 | 1.0 | 33 | Comparative Example |
| 2 | | 10 | 0.50 | 3.6 | 32 | 27 | 1.0 | 27 | Comparative Example |
| 3 | | 15 | 0.75 | 3.6 | 32 | 20 | 0.9 | 23 | Comparative Example |
| 4 | | 20 | 1.00 | 3.6 | 32 | 17 | 0.9 | 20 | Comparative Example |
| 5 | 80 | 15 | 0.19 | 3.6 | 32 | 23 | 0.9 | 25 | Comparative Example |
| 6 | | 30 | 0.38 | 3.6 | 32 | 20 | 0.9 | 22 | Comparative Example |
| 7 | | 60 | 0.75 | 3.6 | 32 | 17 | 0.9 | 21 | Comparative Example |
| 8 | | 80 | 1.00 | 3.6 | 32 | 13 | 0.8 | 8.2 | Comparative Example |
| 9 | 100 | 20 | 0.20 | 3.6 | 32 | 11 | 0.8 | 5.3 | Comparative Example |
| 10 | | 30 | 0.30 | 3.6 | 32 | 8 | 0.6 | 1.9 | Invention Example |
| 11 | | 40 | 0.40 | 3.6 | 32 | 8 | 0.6 | 2.0 | Invention Example |
| 12 | | 50 | 0.50 | 3.6 | 32 | 8 | 0.5 | 1.6 | Invention Example |
| 13 | | 60 | 0.60 | 3.6 | 32 | 7 | 0.6 | 1.9 | Invention Example |
| 14 | | 100 | 1.00 | 3.6 | 32 | 7 | 0.8 | 4.1 | Comparative Example |
| 15 | 200 | 20 | 0.10 | 3.6 | 32 | 9 | 0.7 | 3.2 | Comparative Example |
| 16 | | 30 | 0.15 | 3.6 | 32 | 8 | 0.6 | 1.8 | Invention Example |
| 17 | | 50 | 0.25 | 3.6 | 32 | 8 | 0.5 | 1.5 | Invention Example |

TABLE 1-continued

| No. | Primary recrystallization heating rate (° C./s) S1 | S2 | S2/S1 | Activity of annealing separator Expected value μ(A) | A ≥ 4 Cumulative frequency F (%) | C-direction average size of secondary recrystallized grains (mm) | Grain size of underlying film (μm) | Twin generating ratio (%) | Remarks |
|---|---|---|---|---|---|---|---|---|---|
| 18 | | 100 | 0.50 | 3.6 | 32 | 7 | 0.6 | 1.3 | Invention Example |
| 19 | | 120 | 0.60 | 3.6 | 32 | 7 | 0.6 | 1.7 | Invention Example |
| 20 | | 200 | 1.00 | 3.6 | 32 | 6 | 0.7 | 2.7 | Comparative Example |
| 21 | 400 | 20 | 0.05 | 3.6 | 32 | 9 | 0.7 | 3.4 | Comparative Example |
| 22 | | 30 | 0.08 | 3.6 | 32 | 8 | 0.6 | 1.8 | Invention Example |
| 23 | | 50 | 0.13 | 3.6 | 32 | 7 | 0.4 | 1.1 | Invention Example |
| 24 | | 200 | 0.50 | 3.6 | 32 | 6 | 0.6 | 0.8 | Invention Example |
| 25 | | 250 | 0.63 | 3.6 | 32 | 6 | 0.7 | 2.5 | Comparative Example |
| 26 | | 400 | 1.00 | 3.6 | 32 | 5 | 0.8 | 2.9 | Comparative Example |
| 27 | 100 | 40 | 0.40 | 3.3 | 26 | 7 | 0.8 | 3.8 | Comparative Example |
| 28 | | 40 | 0.40 | 3.5 | 32 | 6 | 0.6 | 0.9 | Invention Example |
| 29 | | 40 | 0.40 | 3.7 | 38 | 6 | 0.4 | 0.7 | Invention Example |
| 30 | | 40 | 0.40 | 3.9 | 43 | 6 | 0.7 | 2.4 | Comparative Example |
| 31 | | 40 | 0.40 | 3.5 | 23 | 5 | 0.8 | 2.3 | Comparative Example |
| 32 | | 40 | 0.40 | 3.8 | 47 | 4 | 0.7 | 2.6 | Comparative Example |

Samples are taken out from longitudinal and widthwise central portions of the product coil thus obtained, to measure C-direction average size of secondary recrystallized gains and also to measure grain size of underlying film constituting grains and twin generating ratio after film exfoliating test by the previously mentioned method. The measured results are also shown in Table 1.

As seen from Table 1, in all steel sheets of Invention Examples produced under conditions of heating rates in the primary recrystallization annealing and MgO in the annealing separator adapted in the invention, average grain size of traces of underlying film constituting grains transferred on exfoliated face at the matrix side after the film exfoliating test is not more than 0.6 μm, and C-direction average size of secondary recrystallized grains is not more than 8 mm, and twin generating ratio after twining test is not more than 2%.

Example 2

A steel slab having a chemical composition shown in Table 2 and the remainder being Fe and inevitable impurities is heated to 1430° C. and soaked for 30 minutes and hot rolled to form a hot rolled sheet having a thickness of 2.2 mm, which is subjected to a hot band annealing of 1000° C.×1 minute, cold rolled to an intermediate thickness of 1.5 mm, subjected to an intermediate annealing of 1100° C.×2 minutes, further cold rolled to obtain a cold rolled sheet having a final thickness of 0.23 mm, and subjected to a treatment of refining magnetic domains by forming linear grooves with electrolytic etching. Thereafter, the steel sheet is subjected to primary recrystallization annealing combined with decarburization annealing of 840° C.×2 minutes in an atmosphere having $PH_2O/PH_2$ of 0.4 by raising temperature to 700° C. at a heating rate S1 between 500~600° C. of 200° C./s and a heating rate S2 between 600~700° C. of 50° C./s and then at an average heating rate of 10° C./s between 700~840° C. Next, the steel sheet is coated on both surfaces with a slurry-state annealing separator composed mainly of MgO having variously changed expected value μ(A) of activity distribution and cumulative frequency F of MgO and added with 10 mass % of $TiO_2$ in an amount of 15 g/m$^2$ so as to provide hydration amount of 3.0 mass %, dried, wound in the form of a coil, subjected to final annealing, coated with a coating liquid of magnesium phosphate-colloidal silica-chromic anhydride-silica powder, and subjected to flattening annealing for the purpose of baking and shape correction to obtain a product coil.

TABLE 2

| No. | Chemical composition (mass %) C | Si | Mn | S | Se | S + Se | sol. Al | N | Other ingredients | Activity of annealing separator Expected value μ(A) | A ≥ 4 Cumulative frequency F (%) | C-direction average size of secondary recrystallized grains (mm) | Grain size of under-lying film (μm) | Twin generating ratio (%) | Remarks |
|---|---|---|---|---|---|---|---|---|---|---|---|---|---|---|---|
| 1 | 0.1 | 3.1 | 0.1 | — | 0.02 | 0.02 | 0.03 | 0.01 | — | 3.6 | 32 | 6 | 0.5 | 1.6 | Invention Example |
| 2 | 0.1 | 3.1 | 0.1 | 0.02 | — | 0.02 | 0.03 | 0.01 | — | 3.6 | 32 | 7 | 0.6 | 1.7 | Invention Example |
| 3 | 0.1 | 3.1 | 0.1 | — | 0.02 | 0.02 | 0.03 | 0.01 | Cu: 0.2 | 3.6 | 32 | 7 | 0.5 | 1.8 | Invention Example |
| 4 | 0.1 | 3.1 | 0.1 | — | 0.02 | 0.02 | 0.03 | 0.01 | Cr: 0.01 | 3.6 | 32 | 6 | 0.6 | 1.7 | Invention Example |
| 5 | 0.1 | 3.1 | 0.1 | — | 0.02 | 0.02 | 0.03 | 0.01 | Ni: 0.01 | 3.6 | 32 | 6 | 0.4 | 1.5 | Invention Example |

TABLE 2-continued

| | Chemical composition (mass %) | | | | | | | | | Activity of annealing separator | | C-direction average | Grain size of | | |
|---|---|---|---|---|---|---|---|---|---|---|---|---|---|---|---|
| No. | C | Si | Mn | S | Se | S + Se | sol. Al | N | Other ingredients | Expected value μ(A) | A ≥ 4 Cumulative frequency F (%) | size of secondary recrystallized grains (mm) | under-lying film (μm) | Twin generating ratio (%) | Remarks |
| 6 | 0.1 | 3.1 | 0.1 | — | 0.02 | 0.02 | 0.03 | 0.01 | Ni: 0.8, Sb: 0.005 | 3.6 | 32 | 5 | 0.4 | 1.6 | Invention Example |
| 7 | 0.1 | 3.1 | 0.1 | — | 0.02 | 0.02 | 0.03 | 0.01 | Sb: 0.1 | 3.6 | 32 | 6 | 0.5 | 1.7 | Invention Example |
| 8 | 0.1 | 3.1 | 0.1 | — | 0.02 | 0.02 | 0.03 | 0.01 | Sb: 0.005, Sn: 0.005 | 3.6 | 32 | 4 | 0.4 | 1.4 | Invention Example |
| 9 | 0.1 | 3.1 | 0.1 | — | 0.02 | 0.02 | 0.03 | 0.01 | Mo: 0.5 | 3.6 | 32 | 6 | 0.4 | 1.5 | Invention Example |
| 10 | 0.1 | 3.1 | 0.1 | — | 0.02 | 0.02 | 0.03 | 0.01 | Bi: 0.001 | 3.6 | 32 | 8 | 0.5 | 1.8 | Invention Example |
| 11 | 0.1 | 3.1 | 0.1 | — | 0.02 | 0.02 | 0.03 | 0.01 | B: 0.001 | 3.6 | 32 | 8 | 0.5 | 1.8 | Invention Example |
| 12 | 0.1 | 3.1 | 0.1 | — | 0.02 | 0.02 | 0.03 | 0.01 | P: 0.06 | 3.6 | 32 | 7 | 0.6 | 1.8 | Invention Example |
| 13 | 0.1 | 3.1 | 0.1 | — | 0.02 | 0.02 | 0.03 | 0.01 | Nb: 0.01 | 3.6 | 32 | 7 | 0.6 | 1.9 | Invention Example |
| 14 | 0.1 | 3.1 | 0.1 | — | 0.02 | 0.02 | 0.03 | 0.01 | V: 0.02 | 3.6 | 32 | 8 | 0.5 | 1.9 | Invention Example |
| 15 | 0.1 | 3.1 | 0.1 | — | 0.02 | 0.02 | 0.03 | 0.01 | — | 3.3 | 26 | 7 | 0.9 | 3.4 | Comparative Example |
| 16 | 0.1 | 3.1 | 0.1 | — | 0.02 | 0.02 | 0.03 | 0.01 | Sb: 0.005, Sn: 0.005 | 3.3 | 26 | 5 | 0.8 | 2.8 | Comparative Example |
| 17 | 0.1 | 3.1 | 0.1 | — | 0.02 | 0.02 | 0.03 | 0.01 | — | 3.8 | 47 | 7 | 0.9 | 3.8 | Comparative Example |
| 18 | 0.1 | 3.1 | 0.1 | — | 0.02 | 0.02 | 0.03 | 0.01 | Sb: 0.005, Sn: 0.005 | 3.8 | 47 | 6 | 0.8 | 3.1 | Comparative Example |

Samples are taken out from longitudinal and widthwise central portions of the product thus obtained coil to measure C-direction average size of secondary recrystallized gains and also measure grain size of underlying film constituting grains and twin generating ratio after film exfoliating test by the previously mentioned method, and the measured results are also shown in Table 2.

As seen from Table 2, in all steel sheets of Invention Examples produced under conditions of heating rates in the primary recrystallization annealing and MgO in the annealing separator adapted in the invention, the average grain size of traces of underlying film constituting grains transferred on exfoliated face at the matrix side after the film exfoliating test is not more than 0.6 and C-direction average size of secondary recrystallized grains is not more than 8 mm, and the twin generating ratio after twining test is not more than 2%.

Example 3

A steel slab comprising C, 0.06 mass %, Si: 3.3 mass %, Mn: 0.08 mass %, S: 0.023 mass %, sol. Al: 0.03 mass %, N: 0.007 mass %, Cu: 0.2 mass %, Sb: 0.02 mass % and the remainder being Fe and inevitable impurities is heated to 1430° C. and soaked for 30 minutes and hot rolled to obtain a hot rolled sheet having a thickness of 2.2 mm, which is subjected to a hot band annealing of 1000° C.×1 minute, cold rolled to obtain a cold rolled sheet having a final thickness of 0.23 mm, and subjected to a treatment of refining magnetic domains by forming linear grooves. Thereafter, the steel sheet is subjected to primary recrystallization annealing by raising temperature to 700° C. at a heating rate S1 between 500~600° C. of 200° C./s and a heating rate S2 between 600~700° C. of 50° C./s and separately subjected to decarburization annealing of 840° C.×2 minutes in an atmosphere having $PH_2O/PH_2$ of 0.4. Next, the steel sheet is coated on both surfaces with a slurry-state annealing separator composed mainly of MgO having an expected value μ(A) of activity distribution of 3.6 and a cumulative frequency F of 32% when an activity A is not less than 4.0 or MgO having an expected value μ(A) of activity distribution of 3.3 and a cumulative frequency F of 43% when an activity A is not less than 4.0 and added with 10 mass % of $TiO_2$ in an amount of 15 g/m$^2$ so as to provide hydration amount of 3.0 mass %, dried, wound in the form of a coil, subjected to final annealing, coated with a coating liquid of magnesium phosphate-colloidal silica-chromic anhydride-silica powder, and subjected to flattening annealing for the purpose of baking and shape correction to obtain a product coil.

A wound core of 1000 kVA is manufactured by using the product coil thus obtained to measure iron loss and the measured result is shown in Table 3. As seen from the results, the transformer using the steel sheet produced under conditions of heating rates in the primary recrystallization annealing and MgO in the annealing separator adapted to the invention is small in the iron loss and low in the building factor.

TABLE 3

| No. | Activity of annealing separator: Expected value μ(A) | Activity of annealing separator: A ≥ 4 cumulative frequency F (%) | Twin generating ratio (%) | Average iron loss of cut sheet W17/50 (W/kg) | Iron loss of transformer W17/50 (W/kg) | Building factor | Remarks |
|---|---|---|---|---|---|---|---|
| 1 | 3.6 | 32 | 1.7 | 0.71 | 0.67 | 0.94 | Invention Example |
| 2 | 3.3 | 43 | 3.9 | 0.78 | 0.86 | 1.10 | Comparative Example |

The invention claimed is:

1. A grain-oriented electrical steel sheet having a chemical composition comprising Si: 1.0~5.0 mass % and Mn: 0.01~1.0 mass % and the remainder being Fe and inevitable impurities and including an underlying film composed mainly of forsterite and an overcoat film, wherein an average grain size of grain traces constituting the underlying film observed on a exfoliated portion side of a steel sheet after the film exfoliating test is not more than 0.6 μm, and a C-direction average size of secondary recrystallized grains is not more than 8 mm, and a twin generating ratio after the twining test is not more than 2%.

2. A grain-oriented electrical steel sheet according to claim 1, which contains in addition to the above chemical composition one or more selected from Cu: 0.01~0.2 mass %, Ni: 0.01~1.0 mass %, Cr: 0.01~0.5 mass %, Sb: 0.01~0.1 mass %, Sn: mass %, Mo: 0.01~0.5 mass % and Bi: 0.001~0.1 mass %.

3. A grain-oriented electrical steel sheet according to claim 1, which contains in addition to the above chemical composition one or more selected from B: 0.001~0.01 mass %, Ge: 0.001~0.1 mass %, As: 0.005~0.1 mass %, P: 0.005~0.1 mass %, Te: 0.005~0.1 mass %, Nb: 0.005~0.1 mass %, Ti: 0.005~0.1 mass % and V: 0.005~0.1 mass %.

4. A method of producing a grain-oriented electrical steel sheet by hot rolling a steel slab having a chemical composition comprising C: 0.001~0.10 mass %, Si: 1.0~5.0 mass %, Mn: 0.01~4.0 mass %, one or two of S and Se: 0.01~0.05 mass % in total, sol. Al: 0.003~0.050 mass %, N: 0.001~0.020 mass % and the remainder being Fe and inevitable impurities, subjecting to a hot band annealing if necessary, subjecting to single cold rolling or two or more cold rollings with an intermediate annealing therebetween to a final thickness, subjecting to primary recrystallization annealing, applying an annealing separator and finally subjecting to final annealing, wherein the primary recrystallization annealing is conducted so as to control a heating rate S1 between 500 and 600° C. to not less than 100° C./s and a heating rate S2 between 600 and 700° C. to not less than 30° C./s but not more than 0.6×S1, and as a main ingredient of the annealing separator is used MgO having an expected value μ(A) of citric acid activity distribution of 3.5~3.8, an activity A of not less than 4.0 and a cumulative frequency F of 25~45%.

5. The method of producing a grain-oriented electrical steel sheet according to claim 4, wherein decarburization annealing is conducted after the primary recrystallization annealing by heating at the above heating rate.

6. The method of producing a grain-oriented electrical steel sheet according to claim 4, wherein the steel slab contains one or more selected from Cu: 0.01~0.2 mass %, Ni: 0.01~4.0 mass %, Cr: 0.01~0.5 mass %, Sb: 0.01~0.1 mass %, Sn: 0.01~0.5 mass %, Mo: 0.01~0.5 mass % and Bi: 0.001~0.1 mass % in addition to the above chemical composition.

7. The method of producing a grain-oriented electrical steel sheet according to claim 4, wherein the steel slab contains one or more selected from B: 0.001~0.01 mass %, Ge: 0.0010.1 mass %, As: 0.005~0.1 mass %, P: 0.005~0.1 mass %, Te: 0.005~0.1 mass %, Nb: 0.005~0.1 mass %, Ti: 0.005~0.1 mass % and V: 0.005~0.1 mass % in addition to the above chemical composition.

8. A grain-oriented electrical steel sheet according to claim 2, which contains in addition to the above chemical composition one or more selected from B: 0.001~0.01 mass %, Ge: 0.001~0.1 mass %, As: 0.005~0.1 mass %, P: 0.005~0.1 mass %, Te: 0.005~0.1 mass %, Nb: 0.005~0.1 mass %, Ti: 0.005~0.1 mass % and V: 0.005~0.1 mass %.

9. The method of producing a grain-oriented electrical steel sheet according to claim 5, wherein the steel slab contains one or more selected from Cu: 0.01~0.2 mass %, Ni: 0.01~1.0 mass %, Cr: 0.01~0.5 mass %, Sb: 0.01~0.1 mass %, Sn: 0.01~0.5 mass %, Mo: 0.01~0.5 mass % and Bi: 0.001~0.1 mass % in addition to the above chemical composition.

10. The method of producing a grain-oriented electrical steel sheet according to claim 5, wherein the steel slab contains one or more selected from B: 0.001~0.01 mass %, Ge: 0.001~0.1 mass %, As: 0.005~0.1 mass %, P: 0.005~0.1 mass %, Te: 0.005~0.1 mass %, Nb: 0.005~0.1 mass %, Ti: 0.005~0.1 mass % and V: 0.005~0.1 mass % in addition to the above chemical composition.

11. The method of producing a grain-oriented electrical steel sheet according to claim 6, wherein the steel slab contains one or more selected from B: 0.001~0.01 mass %, Ge: 0.001~0.1 mass %, As: 0.005~0.1 mass %, P: 0.005~0.1 mass %, Te: 0.005~0.1 mass %, Nb: 0.005~0.1 mass %, Ti: 0.005~0.1 mass % and V: 0.005~0.1 mass % in addition to the above chemical composition.

* * * * *